US005343833A

United States Patent [19]

Shirai

[11] Patent Number: 5,343,833

[45] Date of Patent: Sep. 6, 1994

[54] VALVE GEAR DEVICE FOR INTERNAL COMBUSTION ENGINES

[75] Inventor: Eiji Shirai, Aichi, Japan

[73] Assignee: Aisin Seiki Kabushiki Kaisha, Kariya, Japan

[21] Appl. No.: 120,424

[22] Filed: Sep. 14, 1993

[30] Foreign Application Priority Data

Sep. 14, 1992 [JP] Japan ..... 4-244968

[51] Int. Cl.[5] ..... F01L 1/34

[52] U.S. Cl. ..... 123/90.16; 123/90.17; 123/90.48

[58] Field of Search ..... 123/90.15, 90.16, 90.17, 123/90.48, 90.5

[56] References Cited

U.S. PATENT DOCUMENTS

| | | | |
|---|---|---|---|
| 4,905,639 | 3/1990 | Konno | 123/90.39 |
| 5,090,364 | 2/1992 | McCarroll et al. | 123/90.16 |
| 5,113,813 | 5/1992 | Rosa | 123/90.16 |
| 5,193,496 | 3/1993 | Kruger | 123/90.48 |
| 5,253,621 | 10/1993 | Dopson et al. | 123/90.17 |

*Primary Examiner*—E. Rollins Cross
*Assistant Examiner*—Weilun Lo
*Attorney, Agent, or Firm*—Oblon, Spivak, McClelland, Maier & Neustadt

[57] ABSTRACT

A valve gear device for internal combustion engines comprises a suction and exhaust valve which is driven to be opened or closed by a high-speed cam or low-speed cams through a lifter wherein a guide plate is formed on the cam shaft and a guide groove which constantly engages with the guide plate is formed on the top portion of the body of the lifter. Also, the high-speed cam itself may function as the guide plate. The contacting surface of the high speed cam and the low speed cams can be surely regulated by the guide groove which constantly engages with the guide plate. Accordingly, the present invention can provide a small-sized valve gear device which surely regulates the contacting surface of the high-speed cam and the low-speed cams with the lifter.

2 Claims, 5 Drawing Sheets

(PRIOR ART)

VALVE GEAR DEVICE FOR INTERNAL COMBUSTION ENGINES

BACKGROUND OF THE INVENTION

1. Field of the Invention

The present invention relates to a valve gear device for internal combustion engines.

2. Description of the Related Art

As the related art of the valve gear device for internal combustion engines in the present invention, Japanese Unexamined Patent Publication No. 94,405/1992 (Kokai) discloses a variable valve timing device. As shown in FIG. 5, this variable valve timing device comprises: a high-speed cam low-speed cams 72 and 73 which are provided at both sides of the high-speed cam and a cam shaft 70 to which the low-speed cams 72 and 73 and the high-speed cam 71 are fixed. This device further comprises: a guide 74 which is buried in the cylinder head (not shown) of internal combustion engines; a body 76 which is provided so as to slide freely in the inner peripheral hole 75 of the guide 741 and a slider 77 which is provided so as to slide freely in the body 76. This slider may be constituted in either of the following states: this slider 77 is able to move relatively to the body 76 or this slide is not able to move relatively to the body 76. Furthermore, the body 76 has a detent 78. This detent 78 prevents the body 76 and the guide 74 from rotating relatively to each other. At the top of the guide tube 74, a groove 79 is formed so as to avoid the interference of the high-speed cam 71 and the groove 80 (only the groove for the low-speed cam 72 is shown) is also formed there so as to avoid the interference of the low-speed cams 72 and In this device, the slider 77 is in the shape of cylinder and the top surface of the slider 77 is in the shape of a circle. The diameter of the top surface of the slider 77 is larger than the width of the high-speed cam 71. The contacting surface of the body 76 which is driven by the low-speed cams 72 and 73 should necessarily be located at the outer peripheral side of the slider 77. As the result, the outer peripheral diameter of the body 76 is inevitably enlarged and this has caused to prevent the whole device from being miniaturized.

SUMMARY OF THE INVENTION

It is a technical object of the present invention to miniaturize the valve gear device for internal combustion engines.

In order to resolve the technical object of the present invention, the technical means of the present invention reside in the following: The valve gear device for internal combustion engines comprises: a high-speed cam and a low-speed cam which are fixed to a cam shaft, being adjacent to each other; and a suction and exhaust valve which are driven to be opened or closed by said high-speed cam or low-speed cam through a lifter; wherein said lifter comprises: a body which slides inside of the lifter hole formed at the cylinder head of the engine; a slider which slides inside of the slider hole formed in the body and which engages with said high-speed cam with the same width; a spring which energize said slider toward said high-speed cam; a pin which is supported inside of said body and which is capable to control the relative movement between said body and said slider; and a guide groove which is formed on the top portion of said body and which constantly engages with the guide plate fixed to said cam shaft.

In the above-mentioned valve gear device for internal combustion engines, the lifter doesn't rotate owing to the interaction of the guide plate and the guide groove. And the contacting surface at the lifter top portion of the low-speed cam and the high speed cam are regulated by the interaction of the guide plate and the guide groove. Therefore, even if the lifter suffers abnormal vibration, the contacting of the high-speed cam and the slider is not shifted.

In the valve gear device for internal combustion engines of the present invention, the pin is capable of controlling the mutual movement between the body and the slider. When the mutual movement between the body and the slider is controlled, high-speed cam which engages with the body offers the switching action of the suction and exhaust valve to the lifter. When the mutual movement between the body and the slider is not controlled, low-speed cam which engages with the body offers the switching action of the suction and exhaust valve to the lifter.

In the valve gear device for internal combustion engines of the present invention, the high-speed cam may be used as the guide plate. In this case, the function of the guide groove is carried out by the high-speed cam guiding groove which guides both of side surfaces of said high-speed cam provided at the top portion of the body of the lifter. In this case, the slider hole in which the slider slides opens at the bottom of said high-speed cam guiding groove. Also in this case, the high speed cam is surely kept inside the high-speed cam guiding groove. Therefore, it is preferably that the cam surface of the high-speed cam projects to all surroundings of cam surface of the low speed cam in the centrifugal direction, and that the high-speed cam is inserted into the high-speed cam guiding groove.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Having generally described the present invention, a further understanding can be obtained by reference to a certain specific preferred embodiment which is provided herein for purposes of illustration only and is not intended to be limiting unless otherwise specified.

A preferred embodiment of the valve gear device for internal combustion engines according to this invention will be hereinafter described with reference to the drawings.

Figure 1:
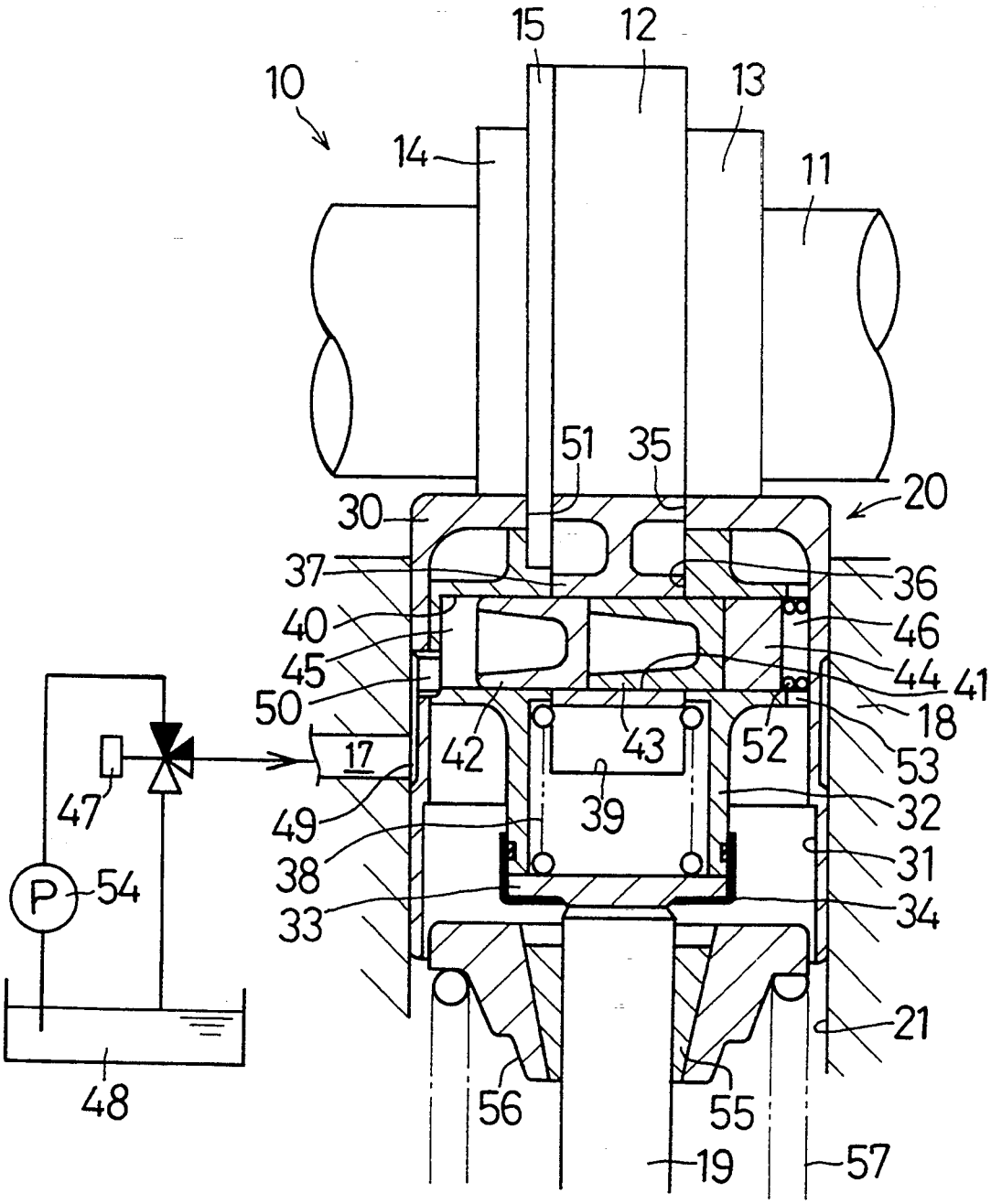
FIG. 1 is a cross-sectional view of the valve gear device for internal combustion engines (when the high speed cam is operated) of the preferred embodiment according to the present invention.
Figure 2:
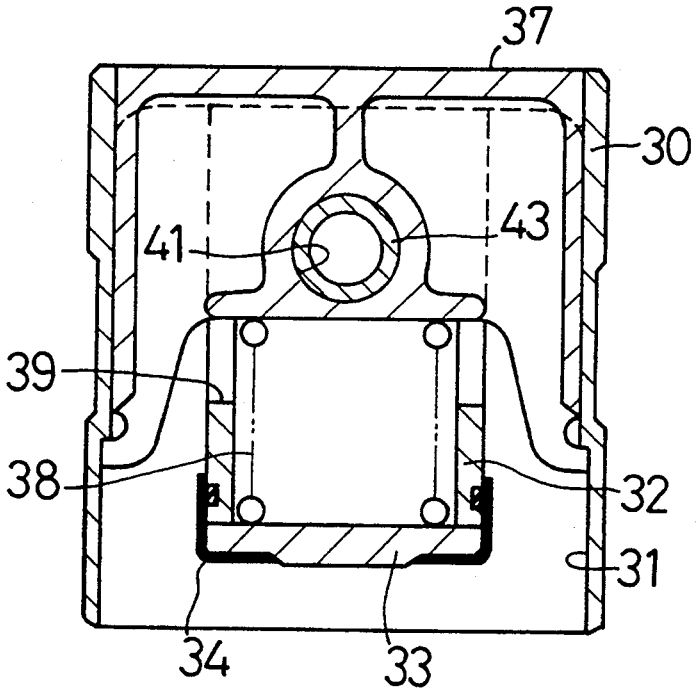
FIG. 2 is a longitudinal section in FIG. 1.
Figure 3:
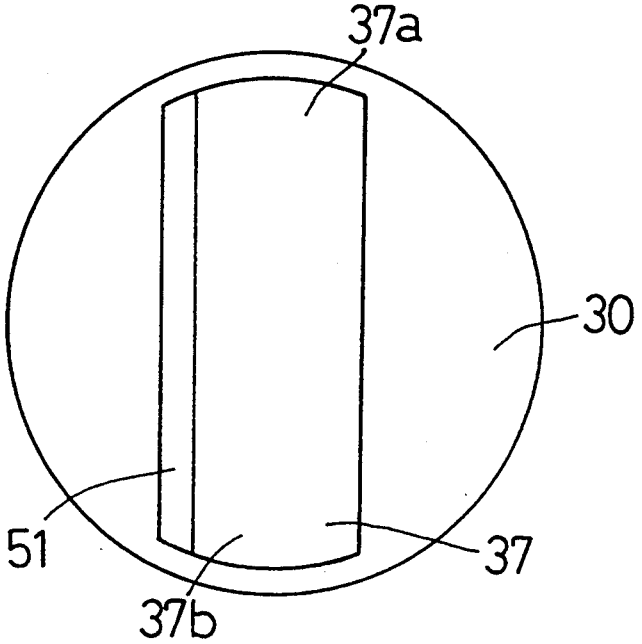
FIG. 3 is a top face perspective view of the lifter in FIG. 1.

As shown in FIGS. 1 to 3, the valve gear device for internal combustion engines of the this preferred embodiment is constituted as follows: a cam shaft 11 is rotatably supported at the cylinder head 18 of the internal combustion engine (not shown); in the cam shaft 11, a high-speed cam 12 and low-speed cams 13 and 14 at both sides of the high-speed cam 12 are provided at a lifter 20; at the space between the high-speed cam 12 and the low-speed cam 14, a guide plate 15 is provided.

At the lifter 20, the first body in the shade of a cup is provided so as to slide freely inside the lifter hole 21 formed at the cylinder head, and the second body is fixed to the internal space 31 of the first body 30. The top surface of the second body 32 is in contact with the upper bottom face of the first body 30 and the retainer 33 is fixed by the snap 34 at the bottom of this retainer 33. A stem end face of either an intake or suction valve and an exhaust valve 19 of an engine is in contact with the bottom surface of this retainer 33. Slider holes 35 and 36 which are overlapped in the axial direction are formed at the first body 30 and the second body 32 respectively, and a slider 37 is provided so as to be able to slide inside these slider holes 35 and 36. The opening widths of slider holes 35 and 36 and the width of the slider 37 are the same as the width of the high-speed cam 12. The number 39 denotes the lowermost bottom of the hole 36. At the space between the bottom of the slider 37 and the retainer 33, a spring 38 is provided and this spring 38 energize the slider 37 toward the high-speed cam 12.

Holes 40 and 41, which are overlapped in the directions which are perpendicular to the axial direction of the lifter 20, are formed at the second body 32 and the slider 37 respectively. Inside these holes 40 and 41, pins 42, 43 and 44 which are divided in three parts are provided so as to be able to slide. The length of the pin 43 is the same as the width of the slider 37. Inside the hole 40, a pressure chamber 45 is formed at the left side surface of the pin 42 and a spring chamber 46 is formed at the right side surface of the pin The pressure chamber 45 is connected with a hydraulic pump of the engine through a control valve 47. The number 48 denotes an oil pan of the engine. In supplying oil hydraulics to the pressure chamber 45 and in exhausting oil hydraulics from the pressure chamber 45, the followings are utilized: a passage 17 formed at the cylinder head 18, a concave groove 49 which constantly engages with the passage 17 and which is continuously formed on the outer peripheral surface of the first body 30; and a passage 50 which constantly engages with the concave groove 49. Inside the spring chamber 46, a spring 52 is provided and this spring 52 energize pins 42, 43 and toward the direction where the volume of the pressure chamber 45 is minimum. When the left edge of the pin 42 is in contact with the left side surface inside the pressure chamber 45, the slider 37 and pin 43 overlap each other. The number 53 denotes the pressure removing hole of the spring chamber The guide groove 51 is formed at the top portion of the first body 30 and the second body 32. Without reference to the sliding positions of the first body 30 and the second body 32, that is, even if each of cams 12, 13 and 14 are in contact with the lifter 20 at the base circle or at the cam surface, the guide groove 51 are constantly engaged with the guide plate 15.

At the stem peripheral surface of the suction and exhaust valve 19, the retainer 56 is fixed through a cotter 55 and one end of valve spring 57 engages with the retainer 56.

In the valve gear device for internal combustion engines having the above-mentioned construction, if the engine starts its running, the cam shaft 11 starts its rotation and then all of high-speed cam 12, low-speed cams 13, 14 and 15 start their rotation driving. If the high-speed rotation is required to the engine, the control means not shown in the figure supplies the oil hydraulics of the hydraulic pump 54 to the pressure chamber 45 through the control valve 47. As the result, pins 42, 43 and 44 moves toward the right direction in the figure by the energizing power of oil hydraulics of the pressure chamber 45. Then, the volume inside the pressure chamber 45 is enlarged and spring 52 is compressed so that the volume inside of spring chamber 46 is reduced. The pin 42 extends over both of holes 40 and 41, and at the same time, the pin 43 extends over both of holes 41 and 40. Accordingly the movement of the slider 37 within the inner holes 35 and 36 is controlled, and the relative movements of the first body 30 and the second body 32 to the slider 37 are controlled. As shown in FIG. 1, cams 12, 13 and 14 is in contact with the lifter 20 at the base circle. As the rotation goes ahead, cams 12, 13 and 14 come to get in contact with the slider 37 of the lifter 20 at the cam surfaces so that the lifter 20 begins to sink inside the hole 21. Then the high-speed cam 12 comes to get in touch with the slider 37 from the edge portion 37*a* (as shown in FIG. 3) of the top surface of the slider 37. So at the edge portion 37*b*, the high-speed cam 12 begins to go away from the slider 37. That means that the total length of the top surface of the slider 37 is engaged with the high-speed cam 12. Also, during the time when the slider 37 is engaged with the cam surface of the high-speed cam 12, the power is affected to be transmitted as the following orders: from slider 37; pins 42 and 43; the second body 32; retainer 33; to the suction and exhaust valve 19. In accordance with the lift volume of the cam surface of the high-speed cam 12, the suction and exhaust valve 19 moves downward against the energizing power of the valve spring 57. Accordingly, the suction and exhaust valve 19 conducts its sucking and exhausting, being separated from the sheet surface which is not shown in the figure. Without reference to the sinking volume of the lifter 20 inside the hole 21, the guide plate 15 constantly engages with the guide groove 51 and the plate 15 functions to prevent rotation of the lifter 20 itself. Furthermore, the guide plate 15 and the guide groove 51 regulate the contacting position of the top portion of the body 30 and the contacting position of the slider 37 with which low-speed cams 13 and 14 and high-speed cam 12 come in contact respectively. Therefore, the high-speed cam 12 constantly and surely comes in contact with the slider 37 without the interference of high-speed cam 12 with the top portion of the body 30. Accordingly, the high-speed cam 12 always engages with the whole length of the top surface of the slider 37. The lifting volume of the low-speed cams 13 and 14 is smaller than the lifting volume of the high-speed cam 12. Therefore, low-speed cams 13 and 14 have no effect on the driving of the suction and exhaust valve of the lifter 20.

Figure 4:
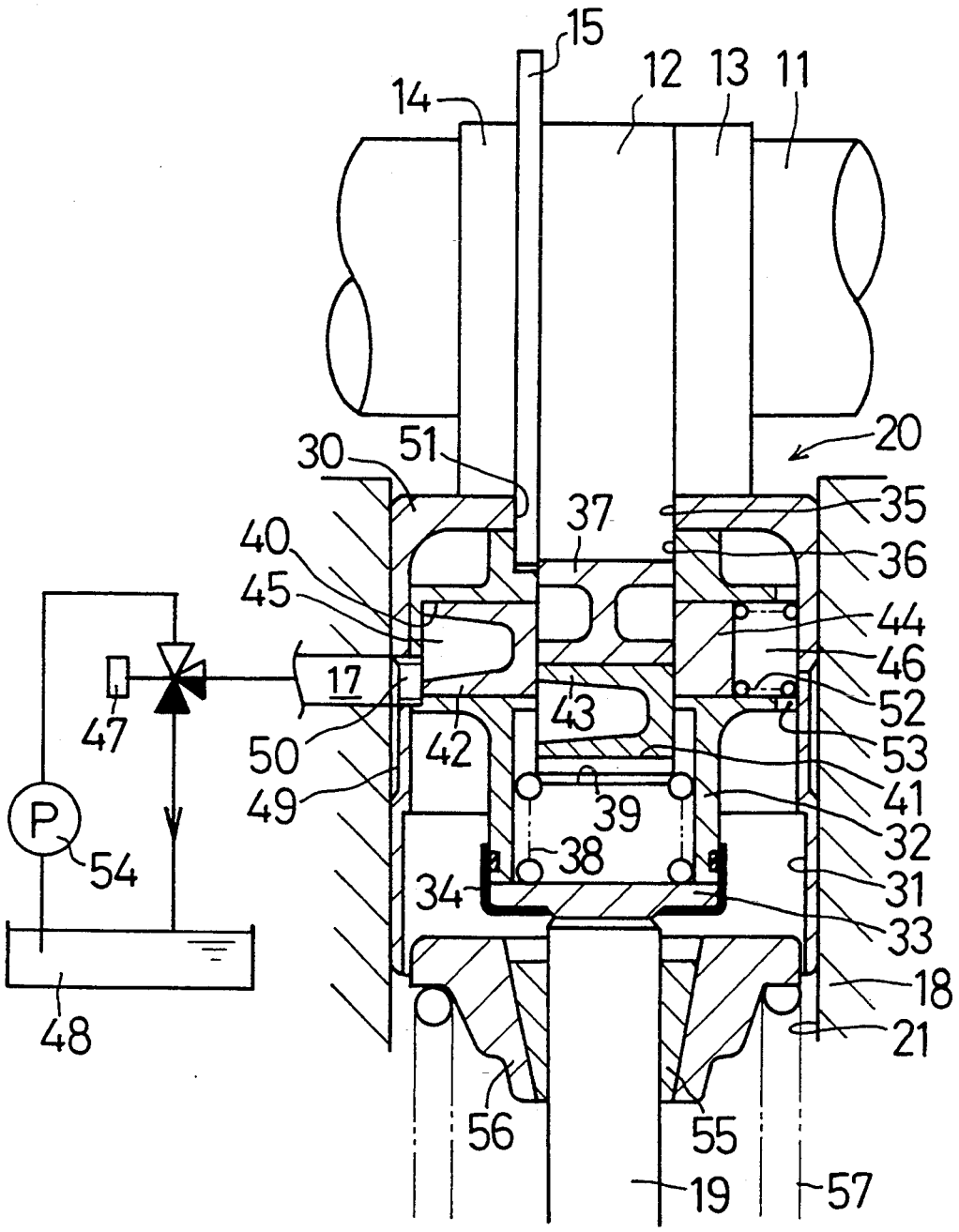
FIG. 4 is a cross-sectional view in FIG. 1 when the low-speed cam is operated.

When the rotation of the low-speed is required to the engine, a control means not shown doesn't supply oil hydraulics of the hydraulic pump 54 through the control valve 47 to the pressure chamber 45 and the pressure chamber 45 is communicated to an oil pan 48 through the control valve 47. As the result, as shown in FIG. 4, pins 42, 43 and 44 moves toward the left direction shown in FIG. 4 by the energizing power of the spring 52. Therefore, the volume inside the pressure chamber 45 is reduced, then the spring 52 is elongated so the volume inside the spring chamber 46 is enlarged. For the pin 43 is overlapping the hole 41 almost completely, the slider 37 is able to slide inside the holes 35 and 36. The high-speed cam 12 is in contact with the lifter 20 at the base circle. As the rotation goes ahead, as shown in FIG. 4, the high-speed cam 12 comes to get in contact with the slider 37 at the cam surface of the high-speed cam 12 so that the slider 37 begins to sink inside the holes 35 and 36 Accordingly, the high-speed cam 12 has no effect on the driving of the suction and exhaust valve of the lifter 20. The maximum sinking volume of the slider 37 is set not to reach to the lowermost edge 39 of the hole 36. The spring 37 is constantly energized toward the high-speed cam 12 by the spring 38, so in accordance to the lift volume of the cam surface of the slider 37, the slider 37 is floatingly supported. The low-speed cams 13 and 14 are in contact with the lifter 20 at the base circle. As the rotation goes ahead, as shown in FIG. 4, the low speed cams 13 and 14 come to get in contact with the first body 30 of the lifter 20 at the cam surfaces so that the lifter begins to sink inside the hole 21. During the time when the first body 30 is engaged with the cam surfaces of the low-speed cams 13 and 14, the power is affected to be transmitted as the following orders: from the first body 30; the second body 32; retainer 33; to the suction and exhaust valve 19. In accordance with the lift volume of the cam surface, the suction and exhaust valve 19 moves downward against the energizing power of the valve spring 57. Accordingly, the suction and exhaust valve 19 conducts its sucking and exhausting, being separated from the sheet surface which is not shown in the figure. Without reference to the sinking volume of the lifter 20 inside the hole 21, the guide plate 15 constantly engages with the guide groove 51 and the guide plate 15 functions to prevent rotation of the lifter 20 itself and at the same time it regulates the relative position of low-speed cams 13 and 14 and the high-speed cam 12 to the lifter 20. Accordingly, the low-speed cams 13 and 14 always engages with the top surface of the first body 30 and they don't engage with the top surface of the slider 37.

In switching of the high-speed side and the low-speed side, by using various conventional methods, it is conducted in the state where each of cams 12, 13 and 14 are in contact with the lifter 20 at the base circle.

Figure 5:
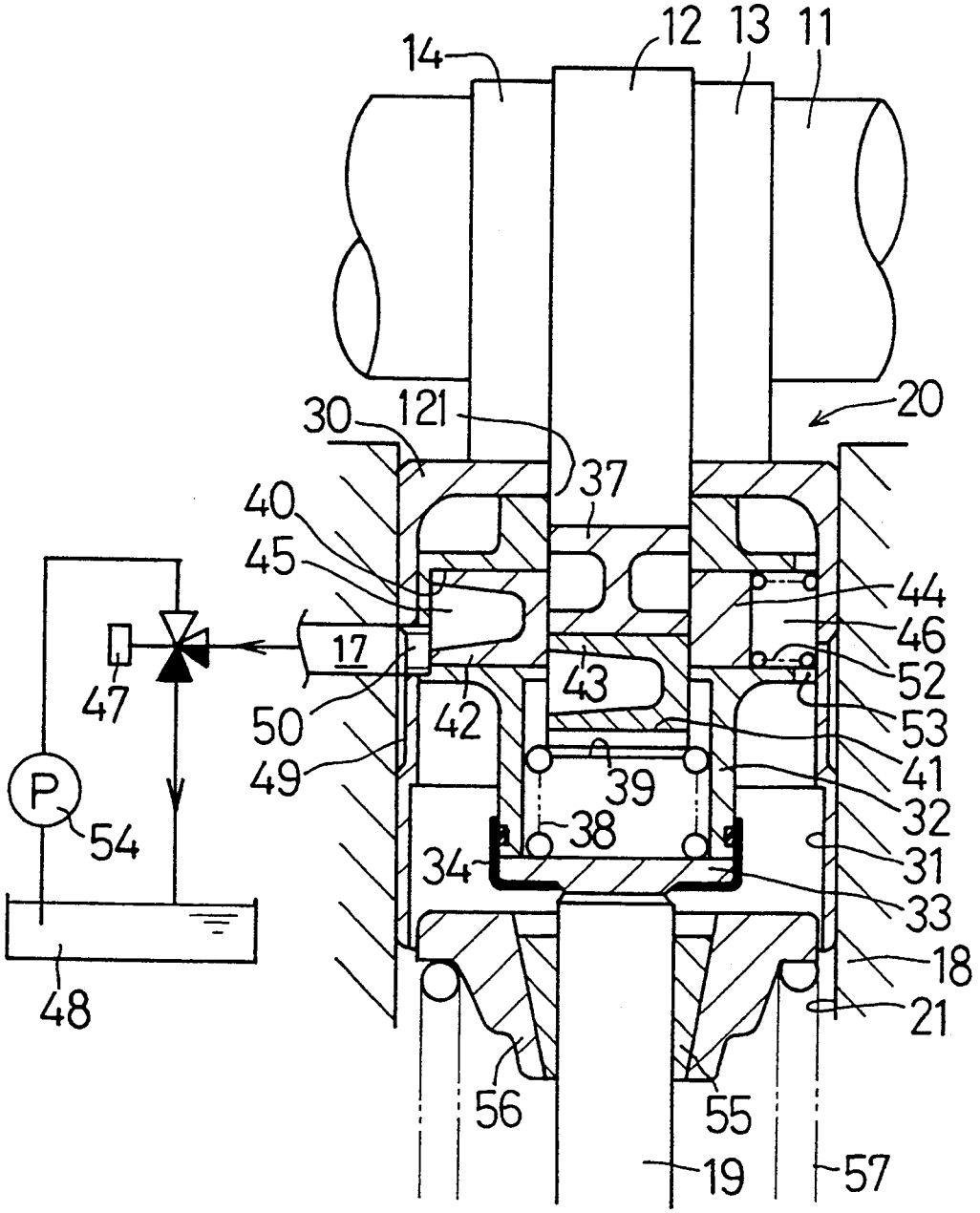
FIG. 5 is a cross-sectional view of the valve gear device for internal combustion engines (when the low-speed cam is operated) of the other preferred embodiment according to the present invention.
Figure 6:
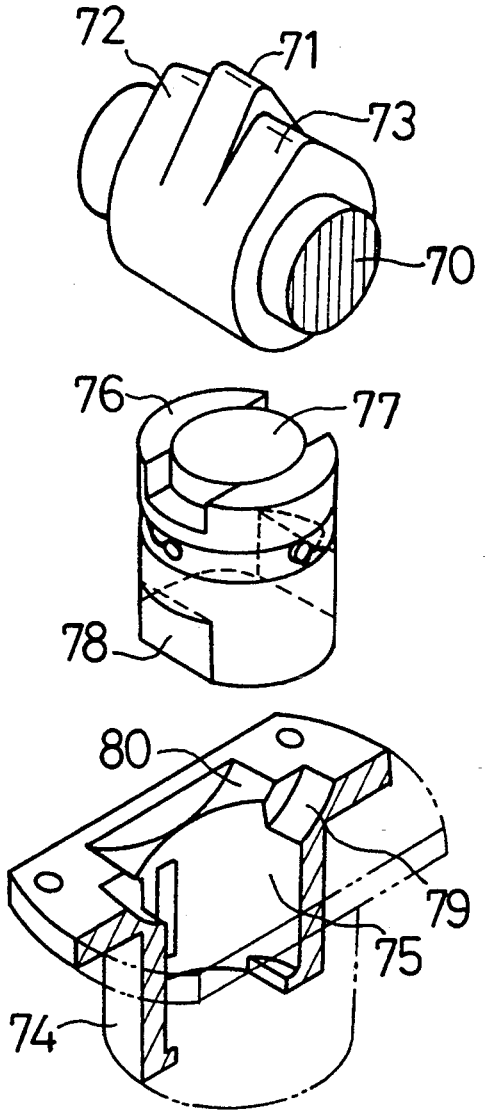
FIG. 6 is a constitutional squint-eyed view of the conventional variable valve timing device.

The apparatus shown in FIG. 5 may be used as the substitute of the apparatus shown in FIG. 4 of the present preferred embodiment. In the apparatus shown in FIG. 5, the high-speed cam 12 is used as the original high-speed cam and it also functions as the guide plate 15 shown in FIG. 4. As is clear from FIG. 5, in the high-speed cam 12 of this preferred embodiment, the cam surface of the high-speed cam 12 projects in the radial direction from the cam surfaces of low-speed cams 13 and 14. The high-speed cam 12 is constructed so as to have the constant width in the axial direction. Accordingly, both of the side surfaces of the high-speed cam 12 respectively project from the low speed cams 13 and 14 in the vertical direction and they are formed in ring shapes.

At the top portion of the first body 30 and body 32, the high-speed cam is inserted in the slider groove 121 whose width is much larger than the width of the high-speed cam 12 which is inserted. The both side surfaces of the high-speed cam 12 constantly slide with both of the inner side surfaces which form the slider groove 121. Without reference to the contacting of each of cams 12, 13 and 14 with lifter 20 or with the cam surface at the base circle, high-speed cam 12 with the predetermined width is constantly inserted into and engaged with the slider groove 121.

Therefore, the high speed cam 12 and the slider 121 which constantly engage each other function to prevent the rotation of the lifter 20 itself and at the same time, they regulate the relative positions of low-speed cams 13 and 14 and high-speed cam 12 to the lifter 20. Accordingly, the cam surfaces of the low-speed cams 13 and 14 always come in contact with the top portion of the first body and it doesn't come in contact with the top surface of the slider 37. Also, the cam surface of the high-speed cam 12 always slides with the top surface of the slider 37 and it doesn't slide with the top surface of the first body 30.

As described above, in the valve gear device for internal combustion engines of the present invention, the lifter doesn't rotate by the interaction of the plate and the rotation preventing groove. Therefore, the high-speed cam always engages with only the top surface of the slider and the low-speed cam always engages with only the top surface of the first body. The width of the slider is the same as the width of the high-speed cam, so the low-speed cam can be provided at the position which is adjacent to the high-speed cam. Accordingly, the whole of valve device including cams and lifter can be miniaturized.

Having now fully described the invention, it will be apparent to one of ordinary skill in the art that many changes and modifications can be made thereto without departing from the spirit or scope of the invention as set forth herein.

I claim:

1. A valve gear device for an internal combustion engine comprises:

a high-speed cam and low-speed cams which are fixed to a cam shaft, being adjacent to each other; and at least one of an intake and exhaust valve which is driven by at least one of said high-speed cam and low-speed cams through a lifter;

wherein said lifter comprises:

a body which slides inside of a lifter hole formed at a cylinder head of the engine;

a slider which slides inside a slider hole formed in said body and which engages with said high-speed cam;

a spring which urges said slider toward said high-speed cam;

a pin which is supported inside of said body and which is capable to control the relative movement between said body and said slider; and a guide groove which is formed on a top portion of said body and which constantly engages with a guide plate fixed to said cam shaft.

2. A valve gear device for an internal combustion engine according to claim 1, wherein said high-speed cam has a constant width in an axial direction thereof and the top portion of said body includes an engaging groove whose width corresponds to the axial width of said high-speed cam which is inserted.

* * * * *

UNITED STATES PATENT AND TRADEMARK OFFICE

CERTIFICATE OF CORRECTION

PATENT NO. : 5,343,833

DATED : SEPTEMBER 6, 1994

INVENTOR(S) : SHIRAI

It is certified that error appears in the above-indentified patent and that said Letters Patent is hereby corrected as shown below:

Column 6, line 3, change "much larger than" to --the same as--.

Signed and Sealed this

Fourth Day of July, 1995

*Attest:*

*Attesting Officer*

BRUCE LEHMAN

*Commissioner of Patents and Trademarks*